United States Patent [19]

Reba

[11] 4,334,340

[45] Jun. 15, 1982

[54] SYSTEM AND METHOD FOR DISPERSING FILAMENTS

[75] Inventor: Imants Reba, Vancouver, Wash.

[73] Assignee: Crown Zellerbach Corporation, San Francisco, Calif.

[21] Appl. No.: 115,308

[22] Filed: Jan. 25, 1980

[51] Int. Cl.[3] ..... D04H 3/03

[52] U.S. Cl. ..... 19/299; 425/72 S; 425/83.1

[58] Field of Search ..... 28/247, 257, 271, 273, 28/103, 254; 19/299, 304, 296–298, 300–303; 425/80.1, 81.1, 82.1, 83.1, 66, 72 S

[56] References Cited

U.S. PATENT DOCUMENTS

| | | | |
|---|---|---|---|
| 2,052,869 | 9/1936 | Coanda | 28/271 X |
| 2,720,005 | 10/1955 | Clark et al. | 19/296 X |
| 3,341,394 | 9/1967 | Kinney | 28/257 X |
| 3,485,428 | 12/1969 | Jackson | 28/273 X |
| 3,512,230 | 5/1970 | Luzzatto | 28/103 |
| 3,692,618 | 9/1972 | Dorschner et al. | 28/247 X |
| 4,172,307 | 10/1979 | Wagner et al. | 19/299 |
| 4,217,387 | 8/1980 | Viezee et al. | 28/103 X |
| 4,300,876 | 11/1981 | Kane et al. | 19/299 X |

FOREIGN PATENT DOCUMENTS

| | | | |
|---|---|---|---|
| 723535 | 12/1965 | Canada | 28/103 |
| 1159601 | 7/1969 | United Kingdom | 28/103 |

*Primary Examiner*—Louis Rimrodt
*Attorney, Agent, or Firm*—Jerome S. Marger

[57] ABSTRACT

A method and system are provided for dispersing a plurality of closely associated filaments so that the dispersed filaments are capable of being deposited, in a random, convoluted pattern, on a moving web-forming surface to form a high machine-direction strength nonwoven product. The filaments are preferably dispersed by impinging same against a fluid-dynamically-assisted, contoured deflection means, preferably comprising a curved, downwardly inclined deflection element which is continuously traversed, generally codirectional with the filament flow, by a stream of air.

26 Claims, 7 Drawing Figures

PRIOR ART

SYSTEM AND METHOD FOR DISPERSING FILAMENTS

BACKGROUND OF THE INVENTION

The present invention relates to a system and method for dispersing a plurality of filaments. If these dispersed filaments are deposited on a moving web-forming surface, they will form a high machine-direction strength nonwoven product having a random, convoluted web pattern.

Filaments for use in the manufacture of nonwovens can be produced by various methods. For example, synthetic polymers can be spun into filaments. These spun filaments can be drawn-off by a high velocity jet system and directed onto a web-forming surface, as in the case of U.S. Pat. No. 3,692,618 to Dorschner. The use of these high velocity jets facilitates high draw-off speed so that relatively large numbers of filaments can be transported through the system on a continuous basis. A compressed fluid, such as air, is employed as the transporting means. However, some of these jet systems have a constriction at the exit of the flow path. The exit constriction creates a back-pressure on the jet system. This, in turn, requires exertion of a higher, primary pressure by the jets to overcome the resultant back-pressure and achieve the required filament velocity. This gives rise to wasted energy, and a higher cost of production ensues.

The above described prior art systems also have a narrow constriction at their inlet which causes the filaments to be moved through the system, and to exit therefrom, in close association with each other. Typically, a plurality of jet systems are spaced laterally across a moving web-forming surface. Therefore, in order to form a continuous web, in the cross-machine direction, this narrow stream of closely associated filaments must be laterally dispersed.

In an attempt to solve this lateral dispersion problem, some formation systems employ complex electrostatic charging apparatus (see U.S. Pat. No. 3,341,394 to Kinney).

Others try to achieve lateral dispersion of the filaments by directing continuous or intermittent air flows, essentially with a cross-machine direction, against vertically traveling filaments as they pass through an open area, after exiting from the high velocity jet system, in an effort to disperse same. In U.S. Pat. No. 3,485,428 to Jackson, for example, horizontally disposed, sequentially directed, in essentially a cross-machine direction, low-pressure fluid is intermittently supplied to a diverging chamber through which strands of yarn pass. The fluid which emanates from the two diametrically opposed jets impinges the high velocity system of filaments and exerts a pushing force or pressure on the filaments, in a reciprocating manner. This approach does not, however, cause heavy denier filaments or filaments moving at extremely high velocities, or substantial numbers of filaments, to be effectively dispersed in a manner required for nonwoven product formation. Instead, the entire filament aggregation is moved from side-to-side, as the filaments are impinged by the intermittently directed air flow, without causing effective dispersion thereof.

In another approach, the continuous or intermittent use of a phenomenon known as the "Coanda effect" can be imparted to filaments passing within an open area between opposed Coanda nozzles. The Coanda effect, which has been known for many years, is exemplified by U.S. Pat. No. 2,052,869 issued to Henri Coanda. Briefly, this phenomenon can be described as the tendency of a fluid, which emerges from an opening, such as a slit, under pressure, to attach itself or cling to and follow a surface in the form of an extended lip of the slit, which recedes from the flow access to the fluid as it emerges from the slit. This creates a zone of reduced pressure in the area of the slit so that any entrainable material which is in the area will be entrained and flow with the fluid which has attached itself to the extended lip.

On commonly owned, pending application U.S. Ser. No. 68,246, for example, an oscillating movement essentially in a cross-machine direction is imparted to the filaments by a pulsating fluid which causes non-steady-state conditions between opposed Coanda nozzles. The use of Coanda nozzles to oscillate filaments exiting a high velocity jet stream, however, requires individual separators for supplying filaments to the open area between the opposed Coanda nozzles. However, the above described separators can exhibit plugging problems, create back-pressure in the jet air guns, and limit filaments' through-put rates. Moreover, they deliver the filaments to the web-forming means in a substantially parallel lay-down pattern so that the web formed is essentially a structure of more or less parallel filaments. The machine-direction strength of webs formed by this technique is insufficient for many converting operations, for example, in diaper liners, and the like.

SUMMARY OF THE INVENTION

The subject invention relates to a system and a method for dispersing a plurality of closely associated filaments so that the filaments are capable of deposition in a convoluted, random pattern on a moving web-forming surface to produce a substantially uniform, high machine-direction strength nonwoven web.

The closely associated filaments which are typically entrained in a stream of air and travel in an essentially vertical direction at high velocity are dispersed by impinging the filaments against a fluid-dynamically-assisted, contoured deflection means, and which preferably comprises a curved, downwardly inclined deflection element, positioned in the path of the descending filaments, which is continuously traversed, generally codirectionally with the filament flow, by a stream of air. The filaments are, on impingement or against the deflection means, laterally dispersed, and the dispersed filaments are impelled in a controled trajectory, in a convoluted, random state. The desired filament dispersion is accomplished, in the preferred case, by the use of a Coanda nozzle as the subject deflection means.

The descending filaments, on impingement against the fluid-dynamically assisted deflection means, are not in substantial frictional communication with the deflection surface per se but, instead, are "cushioned" by the air stream. This, in turn, continuously moves the dispersed filaments traversely with respect to the deflection surface, generally codirectionally with the air flow.

Filaments dispersed by the method and system of the present invention are capable of forming substantially uniform nonwoven webs which exhibit unexpectedly high increases in strength properties, particularly machine-direction tensile and machine-direction stretch. This modification in strength properties of the subject webs results from the deposition of filaments on a web-forming surface in a random, convoluted, lay-down pattern, which provides a higher order of mechanical entanglement in the nonwoven web product. Therefore, nonwoven webs produced by the system and method of this invention are unexpectedly unique when compared with their conventionally dispersed counterparts. Webs formed from dispersed filaments produced by prior art dispersal techniques have machine-direction strength which is only about one-half of their cross-machine-direction strength. Conversely, nonwoven webs formed from similar filaments dispersed according to the teachings of the present invention exhibit machine-direction strength properties, i.e., tensile and stretch, when are at least equal to their cross-machine-directional strength, and having a machine-directional strength preferably at least about 1.5 times as great, and more preferably at least about twice as great, as their cross-machine-direction strength. The cross-machine-direction strength of these latter webs is substantially equal to their conventional counterparts.

The jet system of the present invention is preferably constructed so that the exit constriction present in the prior art dispersal systems is omitted herein. This substantially eliminates the back-pressure created in many prior art apparatuses which, in turn, allows the primary pressure in the jet system to be reduced by at least about 20%, and preferably by at least about 25%, which results in a substantial energy savings.

In a further preferred embodiment, the length of the deflection means is adapted so that a plurality of jet systems can be provided to discharge filaments for impingement thereagainst. In another preferred embodiment, a composite system is provided, including pairs of deflection means disposed in opposed manner one with respect to the other. The trajectory of the dispersed filaments is preferably adapted so that the path of the respective filament streams do not intersect prior to deposition on a web-forming surface.

DETAILED DESCRIPTION OF THE DRAWINGS

DETAILED DESCRIPTION OF THE INVENTION

Figure 1:
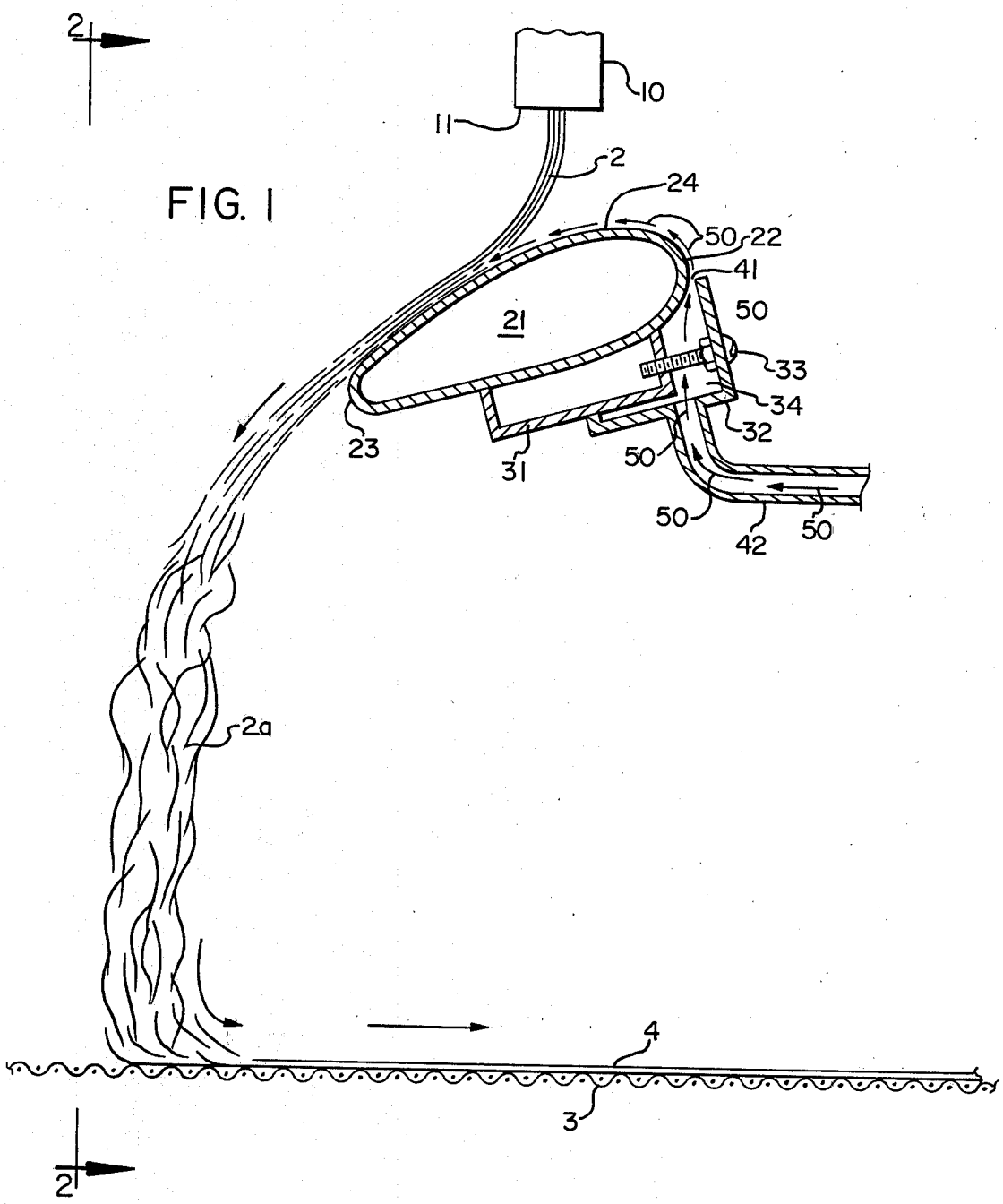
FIG. 1 is a side view of a preferred filament dispersion system of the present invention.
Figure 2:
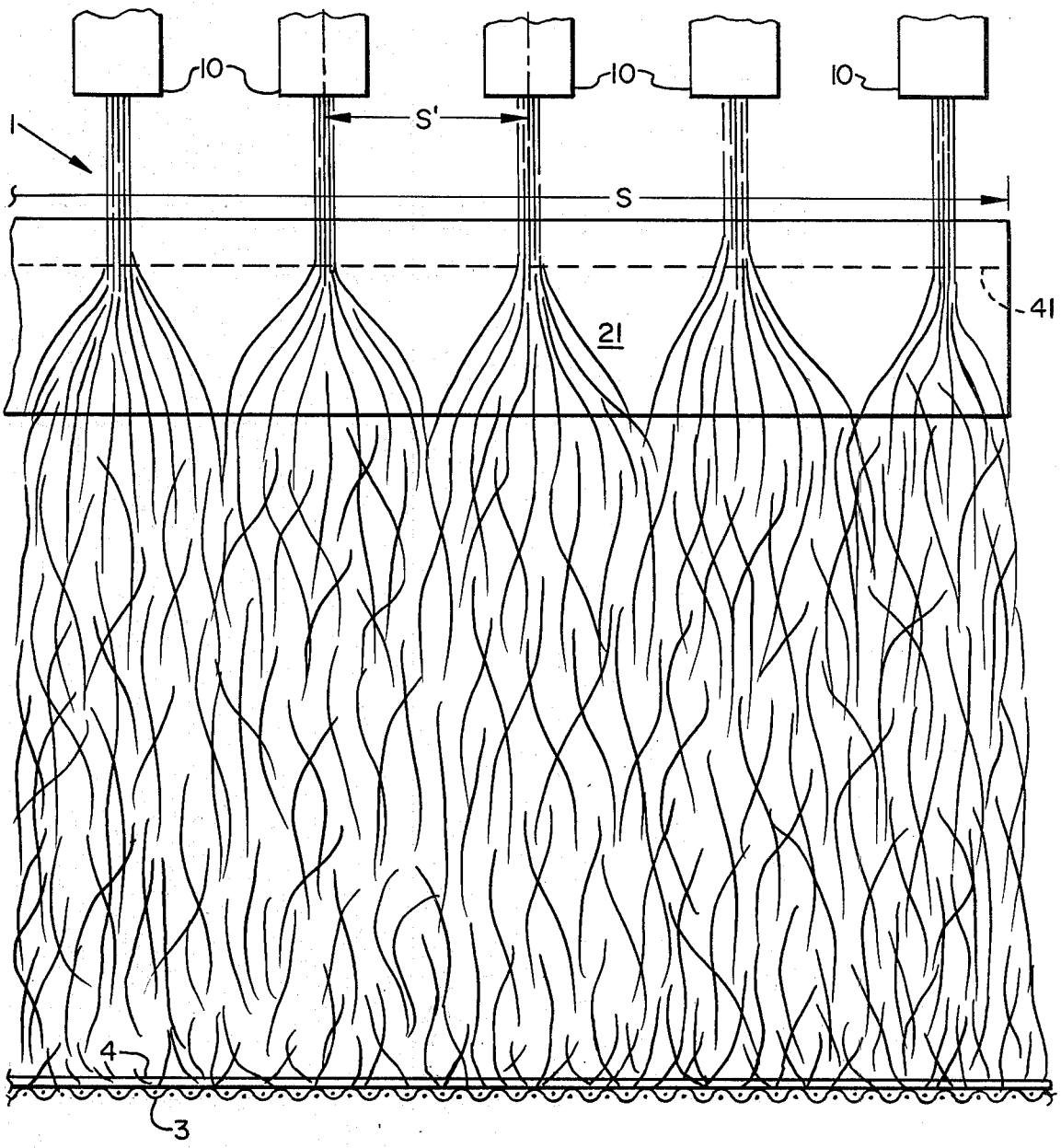
FIG. 2 is a front view of the system shown in FIG. 1.

Referring now to FIGS. 1 and 2, deflection system is provided for dispersing a plurality of filaments 2, which are closely associated with each other, so that the dispersed filaments 2*a* are capable of deposition in a convoluted, random lay-down pattern (see FIG. 7), instead of in a regular lay-down pattern (see FIG. 6), on a web-forming surface 3 of a web-forming means (not shown), to form, for example, nonwoven web 4. Typically, filaments 2 are produced from polymeric materials capable of forming a melt, which can be spun into filaments useful in the production of nonwoven products. These materials are well-known in the prior art. The filaments 2 are generally formed by conventional melt-spinning techniques.

A plurality of filaments 2 are typically transported in an air medium to a high velocity jet system, substantially as described in Dorschner patent, U.S. Pat. No. 3,692,618 (not shown). The number of individual filaments 2 passing through the conventional jet system usually varies from about 15 to about 100. However, by employing the deflection system of the present invention, the number of filaments passing through the system, as compared to the number of filaments passing through a system having a constricted discharge opening, is increased by at least about 30%, and preferably by at least about 50%.

The filaments 2 are drawn downwardly at high velocity by the aerodynamics of the jet system, i.e., at a preferred velocity of at least 100 feet per second, and more preferably at least 200 feet per second. The maximum velocity is preferably up to about 350 feet per second, and more preferably up to about 250 feet per second.

The filaments 2 are drawn through the high velocity jet system and exit through an opening 11 in discharge means 10. A row of these discharge means 10 is depicted in FIG. 2. Discharge means 10 comprises any means for discharging a plurality of closely associated filaments in an essentially downward direction for impingement of said filaments against a fluid-dynamically-assisted deflection means 1 and, if desired, for further moving the filaments 2*a* for deposition on web-forming surface 3. Discharge means 10 can, for example, be a conduit, such as a tube, a pipe, or a nozzle. Contrary to certain prior art separators, it is preferred that, in order to avoid substantial clogging and back-pressure in the high velocity jet system, there is no substantial constriction in the discharge opening 11 in discharge means 10. Since no substantial back-pressure is imparted to the subject jet system, the above described filament velocities can be achieved employing at least about 20%, and preferably at least about 25%, less draw jet pressure than with the prior art separators.

A plurality of filaments 2, in close association with each other, are discharged in an essentially downward direction from discharge means 10, and impinge against fluid-dynamically-assisted, contoured deflection means 1, thereby producing laterally dispersed filaments 2*a*. The deflection means is positioned in the path of the essentially downwardly descending filaments 2. A preferred fluid-dynamically-assisted, contoured deflection means 1 is depicted in FIG. 1 and comprises a curved, downwardly inclined deflection element 21, having respective front and rear ends 22 and 23. The lateral distance "S" of the deflection means 21 (see FIG. 2) is dependent upon the number of discharge means 10 employed, and if a nonwoven fabric is being produced, the cross-machine distance of the web-forming surface 2.

A stream of air 50 is emitted from an air supply source 30 so that it continuously traverses deflection element 21. The air stream 50 preferably moves along and attaches to the contour of the surface, denoted "24", of the deflection element 21. The closely associated filaments 2 impinge, and are cushioned by, the air stream 50, causing the subject lateral filament dispersal. The laterally dispersed filaments 2*a* are then moved generally codirectionally with the air stream 50 so that they continuously traverse deflection element 21 and are impelled in a controlled trajectory in a convoluted, random state.

Figure 6:
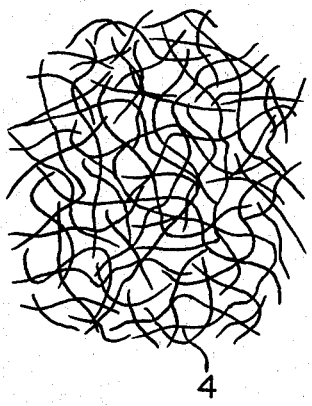
FIG. 6 is a schematic diagram of a regular filament lay-down pattern.
Figure 7:
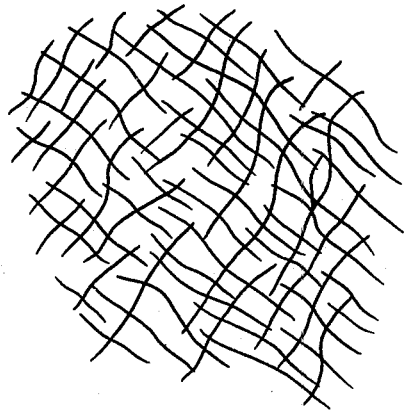
FIG. 7 is a schematic diagram of a random filament lay-down pattern.

In the case of the formation of spunbonded nonwoven fabrics employing the deflection system of this invention, dispersed filaments 2*a* are deposited on web-forming surface 3 in a random, convoluted lay-down pattern. The effect of this random, convoluted deposition, as opposed to the substantially parallel lay-down pattern which is produced using prior art separators is pictorially described in the schematic diagrams of FIGS. 6 and 7, respectively. Unexpectedly, the subject lay-down pattern of FIG. 6 provides a significantly higher level of mechanical entanglement in subsequently formed nonwoven webs than its counterpart. This results in the formation of nonwoven webs which exhibit unexpectedly high increases in machine-direction strength properties, such as tensile and stretch. A discussion of specific machine-direction and cross-machine-direction strength properties of the webs produced by the lay-down patterns of FIGS. 6 and 7, respectively, has been previously provided.

As shown in FIG. 1, deflection system 1 preferably includes a Coanda nozzle comprising deflection element 21 and air supply source 30. For purposes of illustration, the specific Coanda nozzle depicted in FIG. 1 is known as a two-dimensional Coanda nozzle. While any suitable two-dimensional Coanda nozzle may preferably be utilized to practice the teachings of the present invention, this particular embodiment is the most preferred because it may be readily constructed from "off-the-shelf" components. The Coanda nozzle includes previously described deflection element 21 having attached thereto, as by means of intermediate structural element 31, an L-shaped member 32 which extends along the lateral distance "S" of deflection element 21. In this case, deflection surface 24 is a Coanda surface.

As pictured in FIG. 2, the lateral distance "S" of deflection element 21 may be adapted for impingement by filaments 2 from a plurality of discharge means 10. When the formation of a nonwoven web is employed, "S" is generally determined by the desired width of the nonwoven fabric to be formed therefrom. The upwardly extending leg of L-shaped member 32 provides a restricted opening in the form of a slit 41. End walls 34 (not shown) provide a closed chamber with which slit 41 is in air-flow communication. If desired, means may be provided for adjusting the width of slit 41. As in FIG. 2, for example, a plurality of screw-and-nut arrangements, such as indicated by reference 33, may be employed for this purpose. Preferably, slit 41 is adjustable from a closed position, up to about an opening of 0.002 inch, and preferably from an opening of about 0.001 inch, to about 0.010 inch.

Conduit means 42 is connected to L-shaped member 32 and the interior of conduit means 42 is in air-flow communication with the chamber to a plurality of fluid supply entry ports 43. Conduit means 42 is connected at the other end to a source of compressed air (not shown), whereby the nozzle chamber may be pressurized and the flow of a thin layer of compressed air injected upwardly through slit 41. Preferably, due to the Coanda effect, the flow of compressed air will attach itself to deflection surface 24 and proceed in the direction of the arrows to provide the subject fluid lubrication therefor.

Typically, the air flow stream 50 exits slit 41 at a rate of from about 10 standard cubic feet per minute (scfm)/lineal foot up to about 40 scfm/lineal foot, and preferably from about 20 scfm/lineal foot, up to about 30 scfm/lineal foot. Furthermore, the air pressure at slit 41 may be adjusted, in general, so that it is sufficient to effectively disperse the impinging filaments without causing excessive turbulence which may result in formation problems in its subsequent nonwoven formation process. Preferably, a fluid pressure of from about 10 psig up to about 50 psig, and preferably from about 20 psig, up to about 35 psig, is employed for this purpose.

Figure 3:
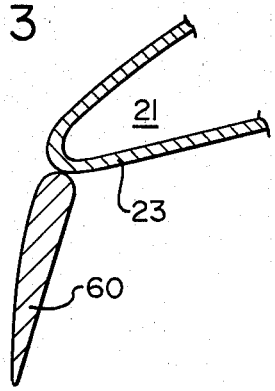
FIG. 3 is a side view of a foil separator means including an auxiliary deflection means 60.

To further control the dispersal of filaments, an auxiliary deflection means 60 (see FIG. 3) may be connected to lower end 23 of deflection element 21. Auxiliary deflection means 60 extends the distance of the deflection surface 24, thereby providing an even higher degree of directional control for the dispersed filaments 2*a*.

As for the vertical disposition of the deflection means 1, for the filaments and operating parameters previously described, the distance, denoted "Z", from the bottom of the discharge means 10 to the outer corner 35 of the L-shaped member 31, is preferably from about one-quarter inch, up to about 13 inches, and more preferably up to about 6 inches.

If the dispersed filaments 2*a* are to be employed in the formation of a nonwoven web, the vertical distance "X" from the outer corner 35 to the web-forming surface 3 is preferably from about 12 inches to about 44 inches. More preferably, "X" is from about 24 inches to about 33 inches for heavy denier filaments, and from about 10 inches to about 24 inches for light denier filaments. In this latter instance, the total vertical distance, X+Z, from the bottom of the discharge means 10 to the web-forming surface 3 is preferably from about 10 inches up to about 45 inches, and more preferably from about 15 inches to about 30 inches. However, for any given deflection system, the total vertical distance, X+Z, is substantially constant, By interchanging discharge means 10 of varying lengths, the total vertical distance can be changed. This interchange can be facilitated by the use of pipe couplings (not shown) which will accept the variable length pipes.

An important aspect of the formation of dispersed filaments 2*a* is the angular disposition of deflection element 21, measured from the center line 21*a* thereof, to the horizontal axis. Preferably, angle $\psi$ is from about 30 degrees to about 60 degrees, and more preferably from about 35 degrees to about 50 degrees.

The distance between respective adjacent discharge means 10 in a given row, measured from centerline-to-centerline of each discharge means, is denoted "S'". The magnitude of S' is dependent upon the number of discharge pipes 10 and if a non-woven web is to be formed from the filaments 2*a*, the width of the web.

Figure 4:
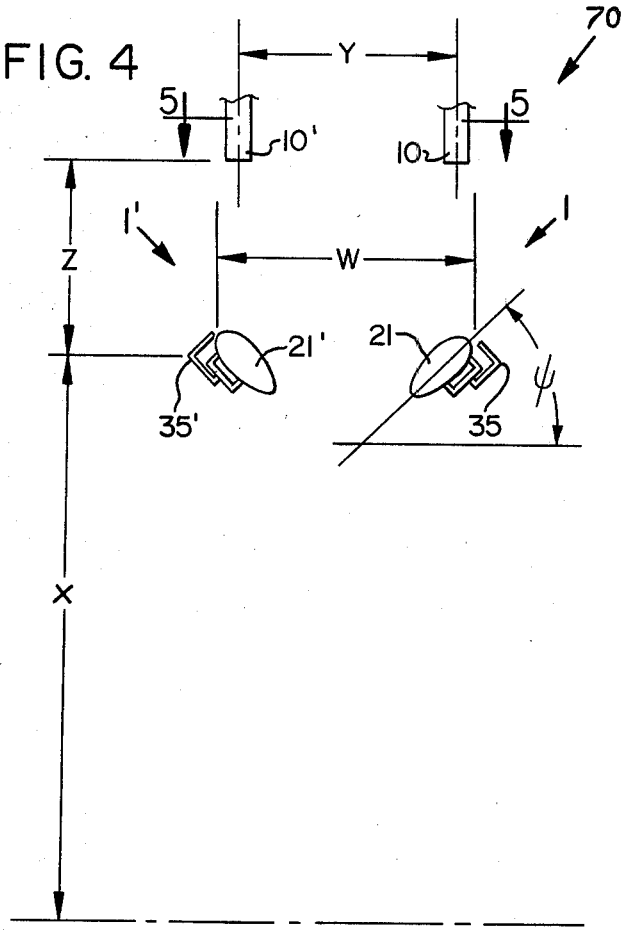
FIG. 4 is a schematic representation of a further preferred embodiment of the present invention comprising a pair of filament deflection systems as described in FIG. 1.

In a preferred embodiment of FIG. 4, a composite deflection system 70 is provided, comprising pairs of deflection elements 21 and 21', which are disposed in an opposed, preferably substantially parallel, manner one with respect to the other. Each of the above deflection elements 21 and 21' is similar in construction to the deflection element 21 set forth in FIGS. 1 and 2. Nonwoven webs formed from the dispersed filaments produced by this novel, composite deflection system 70 have superiormachine-direction strength properties, as previously described.

In order to optimize dispersion of filaments 2*a* under the conditions previously described, discharge means 10 and 10' and deflection means 1 and 1', respectively, should preferably be specifically positioned, as hereinafter described, one with respect to the other. Furthermore, in forming a nonwoven web from dispersed filaments 2a, the respective discharge means 10 and 10' and dispersion systems 1 and 1' are also located in a preferred position with respect to web-forming surface 3. For example, discharge means 10 and 10' are preferably spaced apart a horizontal distance "Y", measured from the respective center lines of each of the opposed discharge means 10 and 10', of from about 5 inches to about 15 inches, and more preferably from about 9 inches to about 11 inches. The opposed deflection means 1 and 1' are preferably spaced apart at a horizontal distance "W", measured from the respective slits 41 and 41', of from about 7 inches to about 20 inches, and preferably from about 10 inches to about 13 inches.

Figure 5:
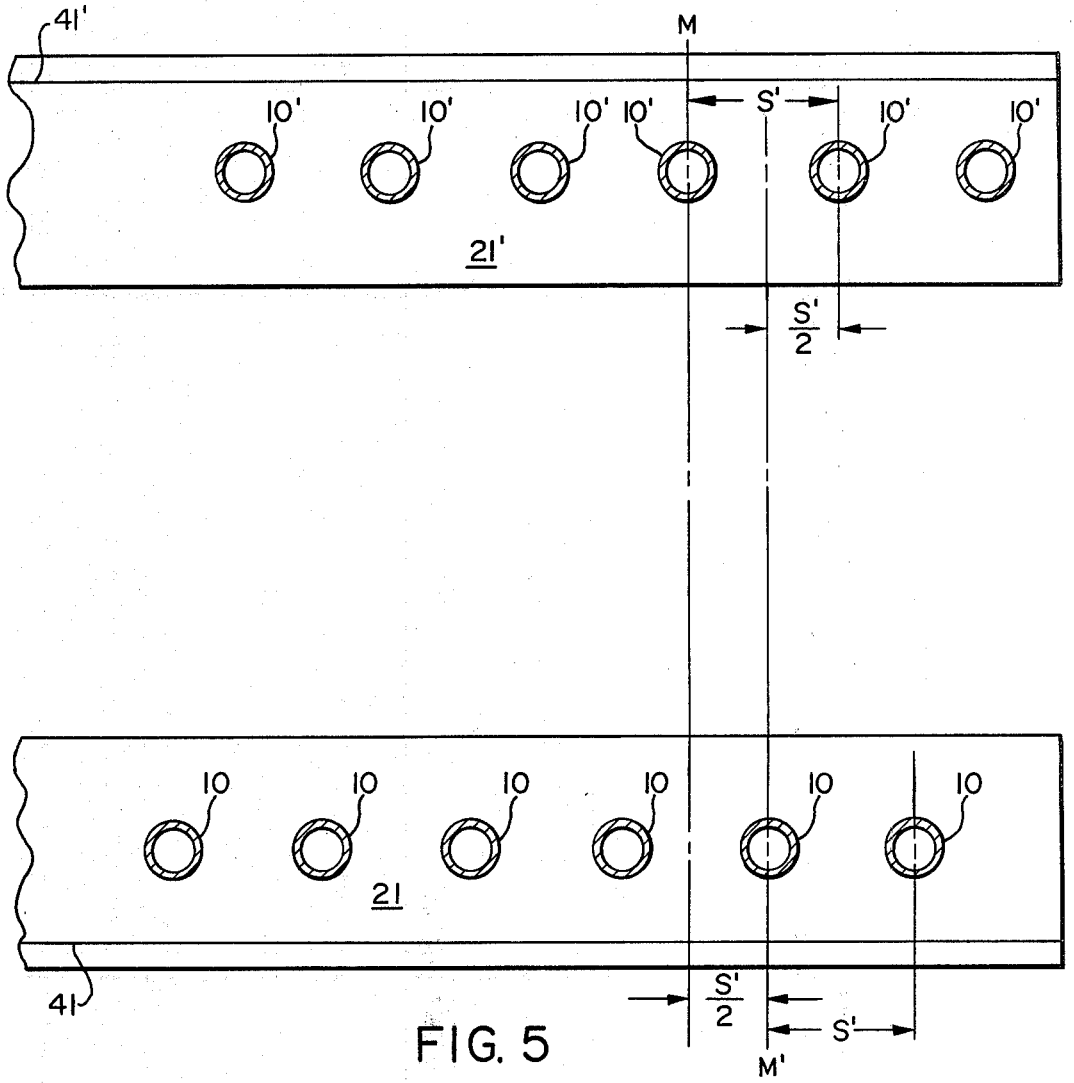
FIG. 5 is a partial top view of FIG. 4 taken along line 5—5.

As shown in FIG. 4, the respective discharge means 10 and 10' are preferably provided in the form of a pair of opposed rows in a substantially parallel disposition one with respect to the other. Each of the rows of the pairs of opposed rows of discharge means 10 and 10' also preferably extends in a substantially parallel disposition with respective deflection elements 21 and 21'. Preferably, as further depicted in FIG. 5, the respective discharge means 10 and 10' in each of the above opposed rows are staggered one with respect to the other. More specifically, the laterally extending centerlines M and M' of discharge means 10 and 10', respectively, which are at right angles to each of the opposed rows of discharge means, are positioned so that they will not intersect discharge means 10' in the respective opposed rows. More preferably, respective discharge means 10 and 10' are positioned so that centerlines M and M' intersect the opposed row of discharge means, at the midpoint therebetween, at a distance S'/2 between adjacent discharge means in the opposed rows.

In another preferred composite deflection system (not shown), a plurality of deflection means 1 are disposed in a tandem arrangement one with respect to the other for dispersing a plurality of filaments 2, as previously described herein.

In the formation of nonwoven webs from dispersed filaments 2a, the uniformity of formation and the overall spacing, respectively, of filaments 2a are important parameters in controling blotching and streaking of the web. Therefore, important operating parameters such as distances Y, W, X, S' and Z, as well as angle $\psi$, must be properly adjusted, one with respect to the other, in order to produce the previously described high machine-directional mechanical strength nonwoven web with acceptable uniformity at high production rates.

I claim:

1. A system for dispersing a plurality of closely associated filaments capable of deposition in a convoluted, random pattern on a moving web-forming surface to produce a substantially uniform, high machine-direction strength web comprising:

a. Means for discharging said closely associated filaments in a stream of air and in an essentially downward direction; and b. A fluid-dynamically-assisted, contoured deflection means comprising a two-dimensional Coanda nozzle including a curved downwardly-inclined deflection element which is continuously traversed, generally codirectionally with the filament flow, by a further stream of air, said deflection means being positioned in the path of said filaments for impingement thereagainst, the filaments, on impingement against said deflection means being laterally dispersed by the latter air stream, the dispersed filaments being impelled in a controlled trajectory, in a convoluted, random state.

2. The system of claim 1, wherein said means for discharging said filaments against said deflection means comprises a plurality of discharge means.

3. The system of claim 1, wherein said discharge means has no substantial constriction in its discharge opening.

4. The system of claim 3, wherein a number of filaments passing therethrough, as compared to the number of filaments passing through a system having a constricted discharge opening, is increased by at least about 30%.

5. The system of claim 1, wherein said nonwoven webs exhibit machine-direction strength properties, which machine-direction strength is at least about 1.5 times as great as the cross-machine direction strength.

6. The system of claim 5, wherein the machine-direction strength of said nonwoven web is at least about twice as great as the cross-machine-direction strength.

7. The system of claim 1, wherein, in order to further control dispersal of filaments, an auxiliary deflection means is connected to the lower end of said deflection element, said auxiliary deflection means extending the distance of the deflection surface, thereby providing an even higher degree of directional control for the dispersed filaments.

8. The system of claim 1, wherein angle $\psi$ is from about 30° to about 60°.

9. The system of claim 1, wherein said latter air stream exits from a restricted opening in said Coanda nozzle, in the form of a slit, at a flow rate of from about 10 scfm per lineal foot, the air pressure at the slit is from about 10 psig.

10. The system of claim 9, wherein said latter air stream flow rate is from about 20 scfm per lineal foot.

11. The system of claim 9, wherein said latter air flow rate is up to about 40 scfm per lineal foot.

12. The system of claim 11, wherein the air pressure is up to about 50 psig.

13. The system of claim 9, wherein the air pressure is from about 20 psig.

14. A system for dispersing a plurality of closely associated filaments capable of deposition in a convoluted, random pattern on a moving web-forming surface to produce a substantially uniform, high machine-direction strength web, comprising:

a. A pair of opposed rows of means for discharging said closely associated filaments in a stream of air and in an essentially downward direction; and b. A pair of opposed fluid-dynamically-assisted, contoured deflection means comprising a pair of two-dimensional Coanda nozzles including a curved, downwardly-inclined deflection element which is continuously traversed, generally codirectionally with the filament flow, by a further stream of air, said deflection means being positioned in the path of said filaments for impingement thereagainst, the filaments, on impingement against said deflection means being laterally dispersed by said latter air stream, the dispersed filaments being impelled in a controled trajectory in a convoluted, random state.

15. The system of claim 14, wherein each of said rows of discharge means is substantially parallel one to the other and extends in a substantially parallel disposition with respect to said deflection means, and said discharge means in each of said opposed rows are staggered one with respect to the other.

16. The system of claim 15, wherein the respective discharge means are positioned so that their centerlines intersect the opposed row of discharge means at substantially the midpoint between adjacent discharge means.

17. A method for dispersing a plurality of closely associated filaments capable of deposition in a convoluted, random pattern on a moving web-forming surface to provide a substantially uniform, high machine-direction strength web, comprising impinging said filaments, traveling in a stream of air and in an essentially downward direction against a fluid-dynamically-assisted, contoured deflection means comprising a pair of two-dimensional Coanda nozzles including a curved, downwardly-inclined deflection element which is continuously traversed, generally codirectionally with the filament flow, by a further stream of air, said filaments being dispersed by said latter air stream, and the dispersed filaments being impelled in a controled trajectory in a convoluted, random state.

18. The method of claim 17, wherein said nonwoven webs exhibit machine-direction strength properties which are at least about 1.5 times as great as their cross-machine-direction strength.

19. The method of claim 17, wherein the machine-direction strength of said nonwoven web is at least about twice as great as the cross-machine direction strength.

20. The method of claim 17, wherein said filaments are discharged in a stream of air and travel in an essentially vertical direction at high velocity, and said deflection means comprises a curved, downwardly-inclined direction element, which is continuously traversed, generally codirectionally with the filament flow, by a further stream of air, the filaments on impingement being cushioned and laterally dispersed by the latter air stream.

21. The method of claim 20, wherein said latter air stream exits from a restricted opening in said Coanda nozzle, in the form of a slit, at a rate of from about 10 scfm per lineal foot, the air pressure at the slit is from about 10 psig.

22. The method of claim 4, wherein said latter air stream flow rate is from about 20 scfm per lineal foot.

23. The method of claim 21, wherein said cushioning air flow rate is up to about 40 scfm per lineal foot.

24. The method of claim 23, wherein the air pressure is up to about 50 psig.

25. The method of claim 20, wherein the air pressure is from about 20 psig.

26. A method for dispersing a plurality of closely associated filaments capable of deposition in a convoluted, random pattern on a moving web-forming surface to provide a substantially uniform, high machine-direction-strength web, comprising impinging said filaments, traveling in a stream of air and in an essentially downward direction, against a pair of opposed fluid-dynamically-assisted, contoured deflection means comprising a pair of two-dimensional Coanda nozzles including a curved, downwardly-inclined deflection element which is continuously traversed, generally codirectionally with the filament flow, by a further stream of air, said filaments being dispersed by said latter air stream, and the dispersed filaments being impelled in a controled trajectory in a convoluted, random state.

* * * * *